United States Patent [19]

Allen

[11] 4,381,079

[45] Apr. 26, 1983

[54] ATOMIZING DEVICE MOTOR

[75] Inventor: Harold T. Allen, Brownsburg, Ind.

[73] Assignee: Ransburg Corporation, Indianapolis, Ind.

[21] Appl. No.: 203,519

[22] Filed: Nov. 3, 1980

[51] Int. Cl.³ ..... B05B 3/04; B05B 3/10

[52] U.S. Cl. ..... 239/214.13

[58] Field of Search ..... 239/3, 11, 700–703, 239/214, 214.11, 214.13, 223, 224, 263, 290, 293, 299; 118/626, 631

[56] References Cited

U.S. PATENT DOCUMENTS 3,043,521 7/1962 Wampler ..... 239/703 X
4,129,966 12/1978 Smart et al. .
4,275,838 6/1981 Fangmeyer ..... 239/703 X

FOREIGN PATENT DOCUMENTS 556845 7/1977 U.S.S.R. ..... 239/224

*Primary Examiner*—Andres Kashnikow
*Attorney, Agent, or Firm*—Jenkins, Coffey, Hyland, Badger & Conard

[57] ABSTRACT

An apparatus for atomizing and dispensing a coating material includes a turbine having a housing and a shaft for rotatably supporting an atomizing device. The shaft includes an outer end extending from the housing for mounting the atomizing device. The atomizing device is mounted on the shaft outer end. The shaft includes a passageway extending between the shaft interior end on the low-pressure side of the turbine and the shaft outer end. Air is supplied through the passageway to reduce the partial vacuum caused by high-speed rotation of the atomizing device, and to reduce effects of the partial vacuum on atomized material pattern configuration.

11 Claims, 7 Drawing Figures

ATOMIZING DEVICE MOTOR

This invention relates to atomization and deposition of fluid coating materials such as paints, and more particularly to an improved drive motor for an atomizing device.

Various types of atomizing devices, coating material feeds, drive mechanisms, and coating methods are well known. There are, for example, the following U.S. Patents: Juvinall et al, U.S. Pat. No. 2,759,764; Juvinall, U.S. Pat. No. 2,754,226; Simmons, U.S. Pat. No. Re. 24,602; Wirth U.S. Pat. No. 3,358,931; Hechenbleikner U.S. Pat. No. 1,853,682; and Kent et al, U.S. Pat. No. 3,011,472. Many coating devices are known which are adapted to be driven by fluid motors, such as air motors. There are, for example: Sigvardsson et al, U.S. Pat. No. 3,067,949; Wampler et al, U.S. Pat. No. 3,121,024; and Allander, U.S. Pat. No. 2,711,926. The increasing use of such fluid motors is attributable, in part, to the ease with which the rotational speeds of atomizing devices driven by such motors can be varied by varying the fluid pressures in the motors.

It is also known to feed fluids along fluid motor shafts for pollution control and for other purposes. There are, for example, U.S. Pat. Nos. 4,129,966 and 4,102,084, and references cited in these patents.

In the operation of high-speed atomizing devices of the type described in U.S. Pat. No. 4,148,932, a phenomenon has been noted. This phenomenon can best be described as a failure of the coating material dispensed from the device to "spread" on the coated surface, causing the coating cross section to exhibit a circular peak or "donut" on a stationary target in the region of the surface adjacent the atomizing device edge. Of course, this donut results in a thinner coating material cross section elsewhere, since it uses coating material which could otherwise be distributed elsewhere in the pattern. It is believed that the donut results, at least partly, from a low-pressure area, or "air void," which exists in the central region of the pattern because of the high-speed rotation of the atomizing device. It is believed that the device itself in operation acts as a pump to pump air out of this region.

According to the invention, a fluid motor for an atomizing device includes a housing, a shaft for rotatably supporting the atomizing device with respect to the housing, the shaft rotatably mounted in the housing and including an outer end extending from the housing for mounting the atomizing device. A passageway is provided from the housing to the shaft outer end to supply gas into the region of the atomizing device adjacent the shaft outer end to increase gas pressure in this region.

The invention may best be understood by reference to the following description and accompanying drawings which illustrate the invention. In the drawings.

Figure 1:
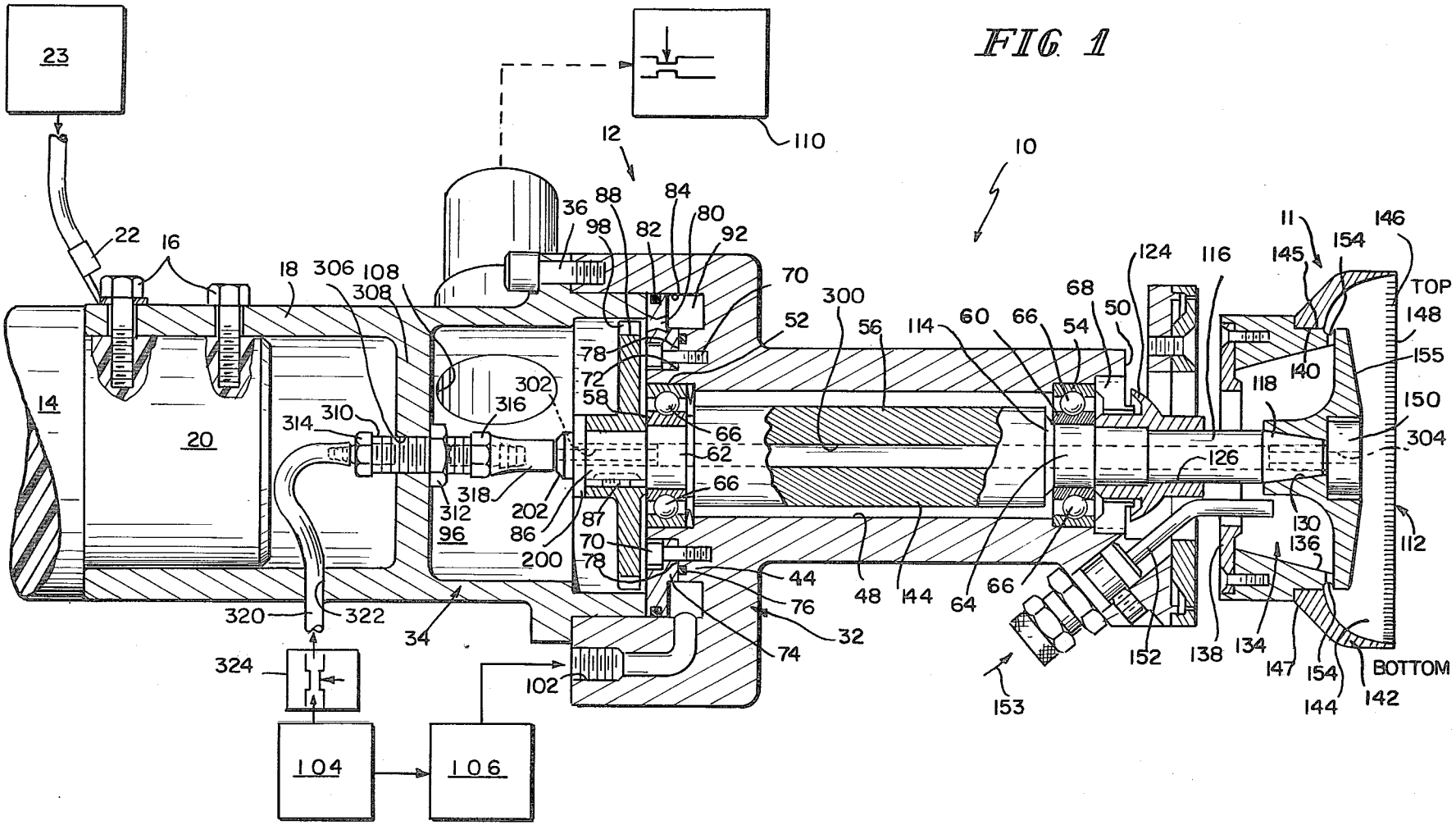
FIG. 1 is a partly fragmentary longitudinal sectional view of a fluid motor and atomizing device arrangement constructed according to the present invention, in a side-feed orientation.

Referring to FIG. 1, a fluid motor 10 for rotating an atomizing device 11 includes a housing 12 which is, for example, cast aluminum. Housing 12 is supported from an insulating post 14 by bolts 16 which extend through a collar 18 on housing 12 and into the reduced lower end portion 20 of post 14. A lead 22 is attached between a bolt 16 and a source of high electrostatic potential 23 (illustrated diagrammatically) to place the fluid motor 10 and atomizing device 11 at high electrostatic potential. The supply of electrostatic potential to device 11 allows the particles of coating material dispensed thereby to be electrostatically charged during the atomization and dispensing process to improve the coating efficiency of the atomized particles in accordance with well-known principles.

Housing 12 is divided into an atomizing device side housing portion 32 and a support means side housing portion 34 joined together by a plurality of cap screws 36 (only one of which is shown). Housing portion 32 includes a central cylindrical portion 44. A bore 48 extends longitudinally through the cylindrical portion 44 from inside housing 12 to surface 50 of portion 32. Bore 48 is provided with bearing races 52, 54 adjacent its ends.

A motor shaft 56 extends longitudinally through bore 48. Bearing races 58, 60 are press-fitted onto portions 62, 64, respectively, of shaft 56. Suitable bearings 66 in races 52, 58 and 54, 60 support shaft 56 for rotation in housing 12. One end of shaft 56 is located in housing portion 32 by a locating nut 68 which holds outer race 54 in position in housing portion 32. Nut 68 is threaded into the end of housing portion 32.

The motor end of housing portion 32 includes an outwardly facing annular groove 72. An annular nozzle plate 74 is mounted in groove 72 by a plurality of screws 79 which extend through countersunk bores in nozzle plate 74 and mating threaded bores in grove groove. An annular groove 76 extends about cylindrical portion 44 in surface 78 of groove 72. Groove 76 carries a sealing ring which prevents leakage of compressed air between nozzle plate 74 and cylindrical portion 44.

Nozzle plate 74 is provided with one or more apertures or nozzles 80 at its periphery. The nozzle plate 74 also contains an outwardly opening groove 82 in which is located an O-ring seal which seals the outer periphery of nozzle plate 74 to the inner side wall 84 of housing portion 32 to prevent leakage of compressed air therebetween.

The inner end 86 of shaft 56 is internally threaded. A drive turbine wheel 88 is placed on the inner end 86 of shaft 56 and held against rotation by a key 87. A washer 200 and screw 202 secure turbine wheel 88 against axial movement on shaft 56. Screw 202 tightens turbine wheel 88 against the inner race 58 on shaft 56.

Housing 12 is divided into a high-pressure or intake side 92 and a low-pressure or exhaust side 96 by nozzle plate 74. Turbine wheel 88 includes a plurality of generally radially extending vanes 98 about its outer periphery. Vanes 98 are in the path of compressed air flow through nozzle 80 between high-pressure side 92 and low-pressure side 96. As the compressed air expands through nozzle 80 from the high-pressure side 92 to the low-pressure side 96, this air reacts against vanes 98, causing turbine wheel 88 and motor shaft 56 to spin. In the fluid motor 10 of FIG. 1, a high-pressure side 92 pressure of 64.7 psia to 34.7 psia, variable to adjust the wheel 88 rpm, and a low-pressure side 96 pressure of 14.7 psia provide satisfactory results.

An air inlet 102 is provided in lower housing portion 32 to supply air from a source 104 of compressed air (illustrated diagrammatically) through a regulator 106 to high-pressure side 92. Regulator 106 controls the air pressure in high-pressure side 92, thereby controlling the pressure differential between high-pressure side 92 and low-pressure side 96 and the rpm of turbine wheel 88.

An exhaust port 108 is provided in housing portion 34 to exhaust from low-pressure side 96 air which has already passed through nozzle plate 74 and wheel 88. Air is exhausted to atmosphere either directly or through a muffler 110 with a variable restrictor. This alternative connection illustrated diagrammatically and in broken lines permits additional control of the pressure differential across wheel 88, and therefore its rpm.

The shaft 56 includes an enlarged spacer portion 114 against which race 60 rests, a smooth cylindrical portion 116, and a frustoconical or straight-tapered portion 118.

A cup-shaped slinger 124 having a central aperture 126 is mounted on portion 116. Slinger 124 prevents coating material, e.g., paint, from migrating along shaft 56 away from atomizing device 11 and fouling the lower bearings 66 of motor 10.

Device 11 includes a tapered central bore 130. The taper of portion 130 matches the taper of portion 118 of shaft 56. These matching tapers facilitate mounting of atomizing device 11 on the shaft 56 and minimize the possibility of misalignment of device 11 on the shaft 56, and the resultant imbalance. These matching tapers 118, 130 allow devide 11 to be replaced quickly and easily by another atomizing device of the same or a different type without the need for critical and time-consuming balancing procedures.

Device 11 includes a central paint cup 134, the inside wall 136 of which flares outwardly at about 15° from the shaft 56 axis. Cup 134 also includes an overhanging lip 138 on its end adjacent surface 50 of fluid motor 10. The flaring surface 136 is provided so that coating material dispensed into cup 134 will be carried toward apertures 154, hereinafter described. Lip 138 prevents coating material dispensed into cup 134 from exiting out of the feed-end of the cup.

Atomizing device 11 further includes a generally cup- or bell-shaped outer portion 142 having a gradually outwardly flaring inside surface 144. Surface 144 flares outwardly to a region 146, from the edge 148 of which the coating material to be dispensed is atomized. Region 146 includes a series of radially and axially extending grooves, the construction and purpose of which is described in U.S. Pat. No. 4,148,932.

Paint cup 134 includes a right circular cylindrical groove 145 which receives a right circular cylindrical portion 140 of portion 142. Portion 142 is secured to paint cup portion 134, e.g., by spot welding at several points 147 around the outsides of portions 134, 142, or by shrink fitting.

Device 11 is held on motor shaft 56 by a bolt 150 which is threaded into a bore in porton 118 of shaft output end 112.

In operation, compressed air is supplied to the high-pressure side 92 of fluid motor 10. The flow of compressed air through nozzles 80 and past driven wheel 88 to the low-pressure side 96 of motor 10 spins shaft 56 and atomizing device 11 at a speed determined by the pressure differential across nozzle plate 74. As previously mentioned, this differential can be varied by varying the pressure difference between the pressure in the side 92 and the pressure in side 96 by adjusting regulator 106, or, where a variable restrictor muffler 110 is used, by adjusting it. As device 11 spins, fluid coating material, e.g., high-solids paint, is supplied through a paint tube 152 to the interior of paint cup 134 in the direction indicated by arrow 153. Paint tube 152 is attached to the motor housing 12.

Paint dispensed from paint tube 152 is moved along side wall 136 toward edge 148 of paint cup 134 due, in part, to centrifugal force. The paint is dispensed through the several small apertures 154 in wall 136 at the level of surface 144. The paint passes through apertures 154, outwardly and along surface 144 to region 146. The distributed paint is atomized at edge 148 as it is thrown from device 11. Electrostatic power supply 23 provides electrostatic charge to the atomized particles of paint dispensed from edge 148.

Figure 6:
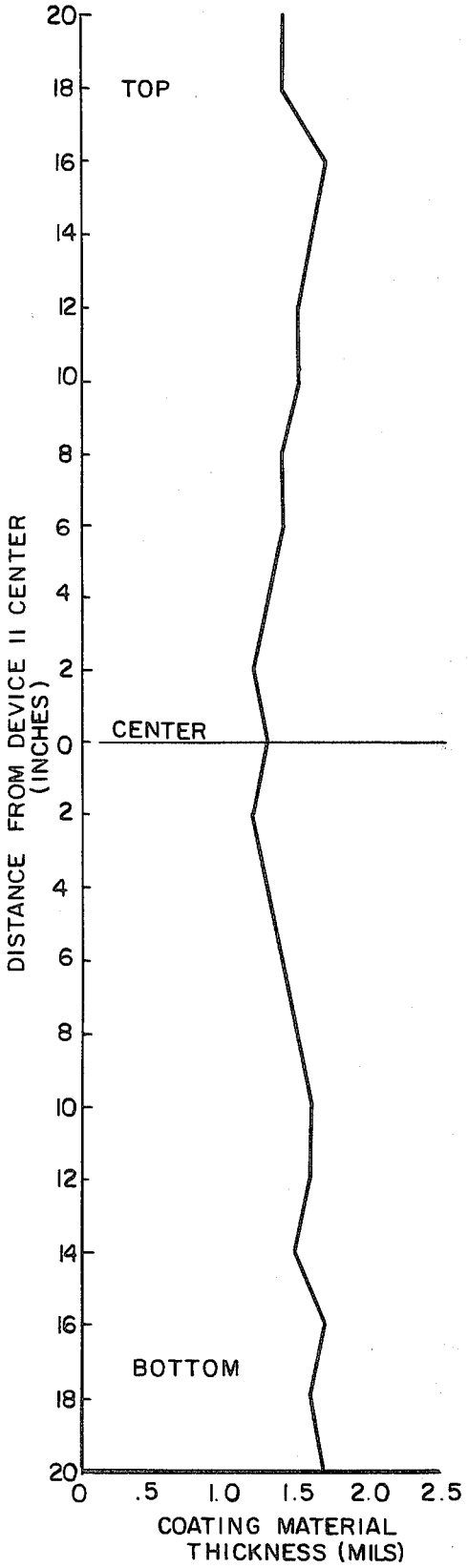
FIG. 6 PRIOR ART
FIG. 6 is a spray pattern available with an atomizing device of the type illustrated in FIGS. 1–5 on a prior art turbine motor.

The system described thus far produces a spray pattern, or film build, best illustrated in FIG. 6. This drawing is a cross-section of a typical coating material film from vertical top to vertical bottom, with the center of shaft 56 being located at the vertical center (labelled center) of FIG. 6. It will be noted that the film peaks at a distance of 16 inches (40.64 cm) above the vertical center of the shaft 56 and peaks, although somewhat less noticeably, possibly due to gravitational effects, at about 16 inches (40.64 cm) below the center of shaft 56. This result was achieved with an atomizing device 11 having a diameter at edge 148 of 2.875 inches (7.3 cm). Various reasons have been posed for this non-uniform film build. Among these reasons is that the extremely high-speed rotation (illustratively, up to 40,000 rpm and higher) of device 11 pumps air out of the space between device 11 and the target being coated with coating material dispensed therefrom. This partial vacuum reduces the interaction between atomized coating material and the air between device 11 and the target, reducing "spread" of the pattern. The pattern that develops has a thinner coating of film in the center with a peak essentially surrounding the center. Additionally, since some small amount of air is drawn into this partial vacuum across the path of coating material atomized from edge 148, some coating material is deposited on the hub 155 of device 11. This results in cleaning difficulties and other difficulties, particularly in those applications where coating material color change cycles occur with substantial frequency (e.g., one color change every thirty seconds).

Figure 7:
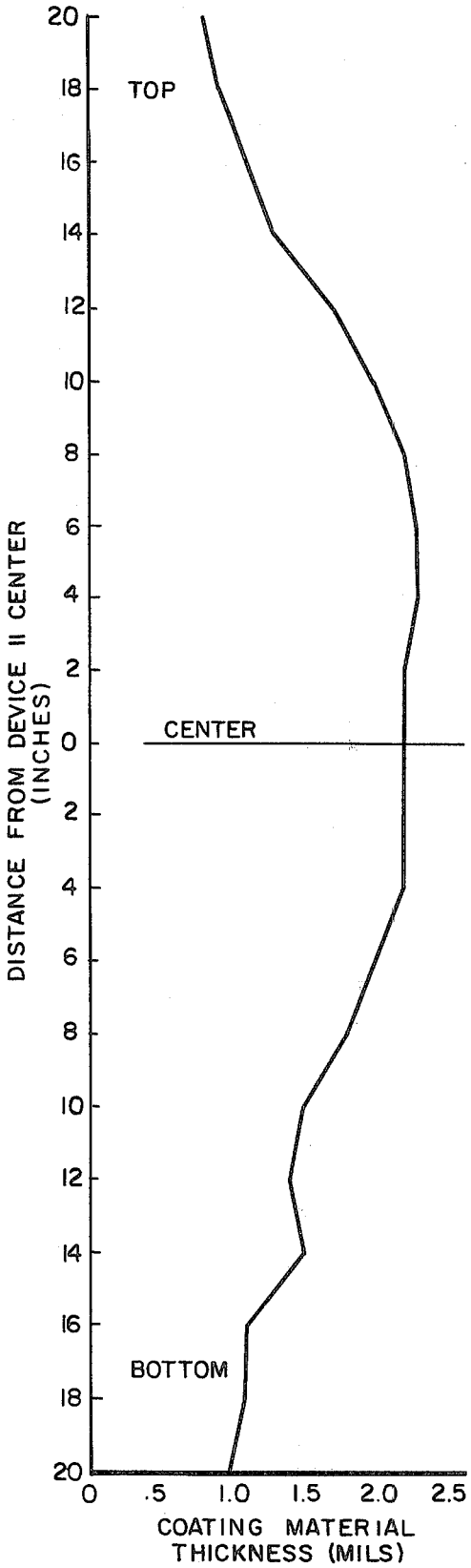
FIG. 7 is a spray pattern available with the atomizing device air turbine motor combinations of FIGS. 1–5.

In order to overcome this partial vacuum, shaft 56 includes a central longitudinal bore 300. Retaining screw 202 includes a registering bore 302. Bolt 150 includes a registering bore 304. A threaded aperture 306 is provided through the back wall 308 of low-pressure chamber 96. A tube 310 having a threaded exterior is threaded into aperture 306 and locked in place by a lock nut 312. A barb fitting 314 is threaded into the end of tube 310 outside of low-pressure chamber 96, and a barb fitting 316 is threaded into the end of tube 310 within low-pressure chamber 96. A length of tubing 318 is placed over the nipple or barb end of the fitting 316, and extends toward, and remains slightly out of contact with, retaining screw 202. A length of electrically insulative tubing 320 is placed over the nipple or barb of fitting 314, and exits through an opening 322 provided in collar 18. Air is supplied through tubing 322 from compressed air source 104 through a variable restrictor 324, so that low-pressure air is fed along shaft 56 and exits through bolt 150 to disrupt the low-pressure area in the center of the coating material pattern illustrated in FIG. 6. This renders the coating material pattern cross-section like that illustrated in FIG. 7, which peaks essentially at the center (labelled center) of shaft 56 and falls away gradually and uniformly from the center, both toward the top of the pattern and toward the bottom of the pattern.

As an alternative to supplying compressed air from the driving air source 104 for motor 10 through a variable restrictor 324, air may be supplied from a lower-pressure source, such as the shaping air source which is frequently provided for shaping the pattern of coating material.

Additionally, because of the construction of the motor with the shaft 56 inner end terminating in low-pressure chamber 96, motor 10 exhaust air can be fed directly through passageways 302, 300, 304 from low-pressure chamber 96 to disrupt the void. This essentially provides a parallel exhaust path for spent air in the low-pressure side of the chamber. The variable restrictor 110 on the exhaust 108 of motor 10 can be used in parallel with the passageways 302, 300, 304 to determine how much air is fed along these passageways to disrupt the void. A problem associated with this kind of arrangement, particularly in very small fractional horsepower turbines, is that their performance is significantly affected by loading of the exhaust which occurs when any device such as variable restrictor 110 is used. However, these effects can be carefully compensated for by experimentation with different parallel exhaust flow rates from exhaust 108 and through passageways 302, 300, 304.

Referring now to FIGS. 2–5, a fluid motor 10 for rotating an atomizing device 11 (FIGS. 2 and 4) includes a housing 12 which is constructed partly from cast aluminum and partly from a filled synthetic resin. Housing 12 is molded into a synthetic resin insulating post 14 through which are provided all necessary services to the motor and atomizing device. A lead 22 (FIG. 2) couples the conductive components of motor 10 and device 11 to a source 23 of high electrostatic potential 23 (illustrated diagrammatically) to place the fluid motor 10 metal components and atomizing device 11 at high electrostatic potential. The supply of electrostatic potential to device 11 allows the particles of coating material dispensed thereby to be electrostatically charged during the atomization and dispensing process to improve the coating efficiency of the atomized particles in accodance with well-known principles.

Figure 5:
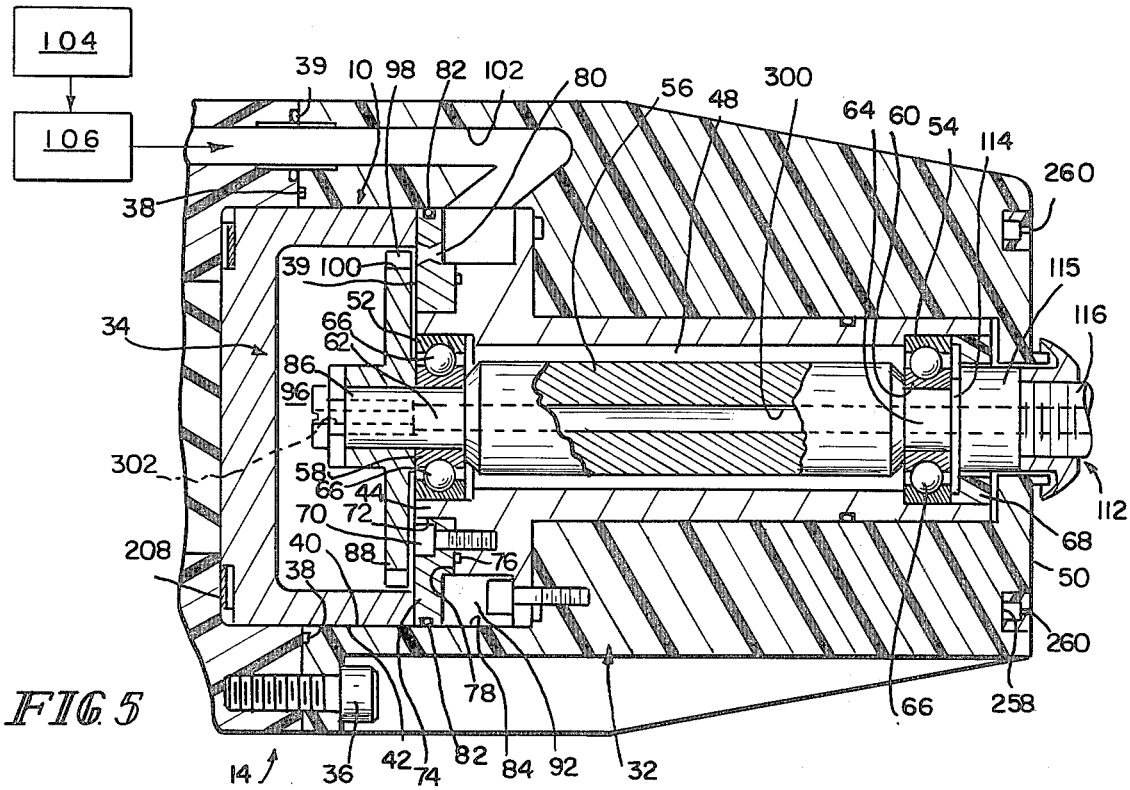
FIG. 5 is a partly fragmentary longitudinal sectional view of the apparatus of FIGS. 2–4, taken generally along section lines 5—5 of FIG. 3.

Turning to FIG. 5, housing 12 is divided into an atomizing device side housing portion 32 constructed largely from synthetic resin and a support means side housing portion 34 secured together by a plurality of cap screws 36, only one of which is shown. O-ring seals 38 are provided in grooves 39 to prevent high-pressure air leakage from between adjacent surfaces 40, 42, respectively, of housing portion 32, 34 to prevent air in housing 12 from escaping between the housing portions. See FIG. 5. Housing portion 32 includes a central cylindrical portion 44. A bore 48 extends longitudinally through the cylindrical portion 44 from inside housing portion 34 to surface 50 of portion 32. Bore 48 is provided with bearing races 52, 54 adjacent its ends.

A motor shaft 56 extends longitudinally through bore 48. Bearing races 58, 60, respectively, are press-fitted onto portions 62, 64, respectively, of shaft 56. Suitable bearings 66 in races 52, 58 and 54, 60 support shaft 56 for rotation in housing 12. One end of shaft 56 is located in housing portion 32 by a locating ring 68 which holds lower outer race 54 in position in housing portion 32. Ring 68 is threaded into housing portion 32.

One end of housing portion 32 includes an outwardly facing annular groove 72. An annular nozzle plate 74 is mounted in groove 72 by a plurality of screws 70 which extend through countersunk bores in nozzle plate 74 and mating threaded bores in groove 72. An annular groove 76 extends about cylindrical portion 44 in the bottom surface 78 of groove 72. Groove 76 carries a sealing ring which prevents leakage of compressed air between nozzle plate 74 and cylindrical portion 44.

Nozzle plate 74 is provided with a nozzle 80 at its periphery. The nozzle plate 74 also contains an outwardly opening groove 82 in which is located an O-ring seal which seals the outer periphery of nozzle plate 74 to the inner side wall 84 of housing portion 32 to prevent leakage of compressed air therebetween.

The inner end 86 of shaft 56 is internally threaded. A turbine wheel 88 is placed on the inner end 86 of shaft 56. A washer 200 and screw 202 secure turbine wheel 88 against axial movement on shaft 56. Screw 202 tightens turbine wheel 88 against the inner race 58 on portion 62 of shaft 56.

Housing 12 is divided into a high-pressure, or intake, side 92 and a low-pressure, or exhaust, side 96 by nozzle plate 74. Turbine wheel 88 includes a plurality of generally radially extending vanes 98 about the outer periphery 100 thereof. Vanes 98 are in the path of compressed air flow through nozzle 80 between high-pressure side 92 and low-pressure side 96. As the compressed air expands through nozzle 80 from the high-pressure side 92 to the low-pressure side 96, this air reacts against vanes 98, causing turbine wheel 88 and motor shaft 56 to spin. In the fluid motor 10 of FIGS. 2–5, a high-pressure side 92 pressure of 64.7 psia to 34.7 psia, variable to adjust the wheel 88 rpm, and a low-pressure side 96 pressure of 14.7 psia provide satisfactory results.

An air inlet 102 is provided in housing portion 32 to supply air from a source 104 of compressed air through an adjustable regulator 106 to high-pressure side 92. Regulator 106 controls the air pressure in high-pressure side 92, thereby controlling the pressure differential between high-pressure side 92 and low-pressure side 96, and the rpm of turbine wheel 88.

An exhaust passageway 108 (FIG. 4) is provided in housing portion 34 to exhaust from low-pressure side 96 air which has already passed through nozzle plate 74 and wheel 88. Air is exhausted to atmosphere through a muffler, not shown, but of the type illustrated diagrammatically in FIG. 1.

Figure 4:
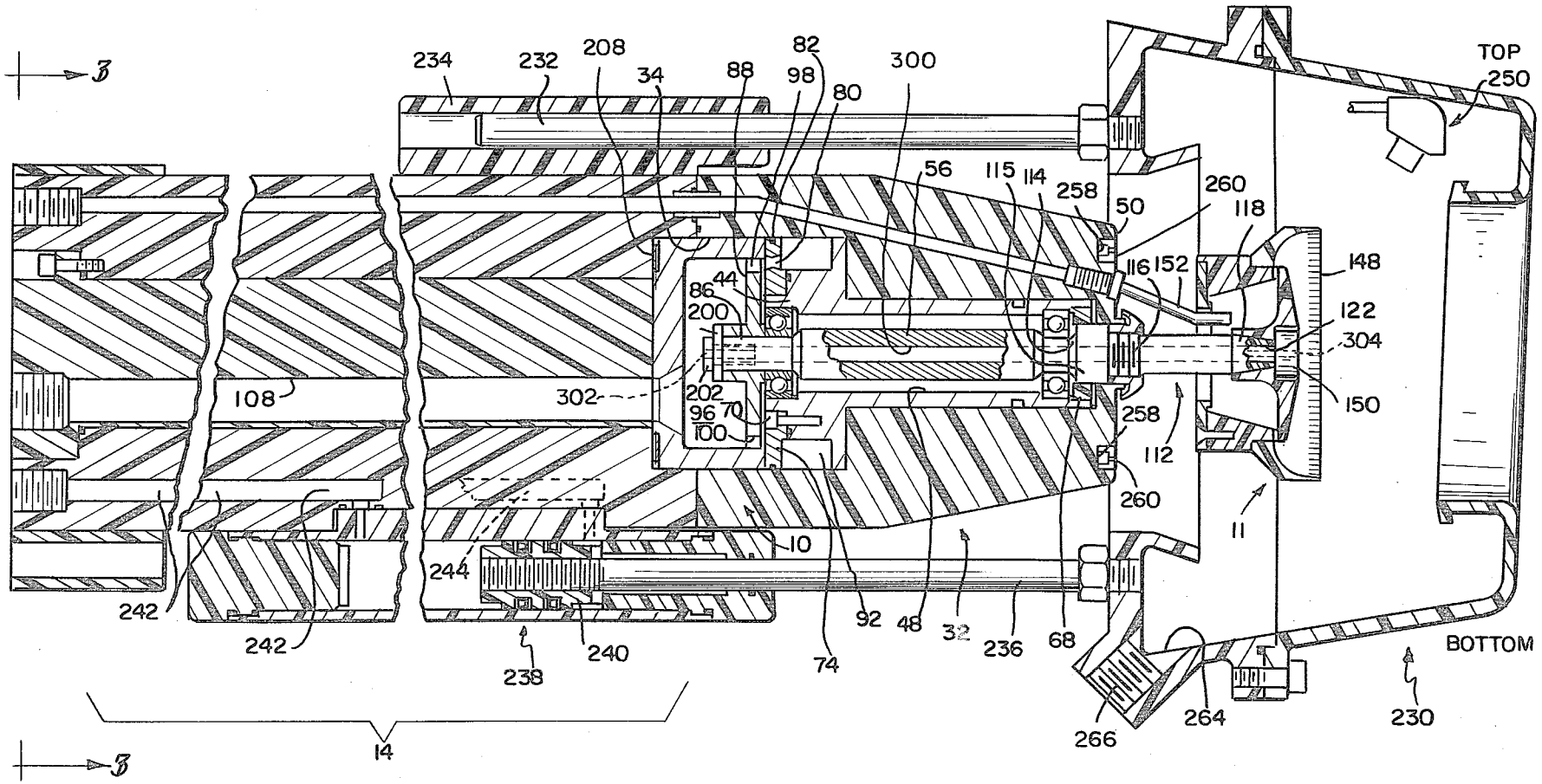
FIG. 4 is a partly fragmentary longitudinal sectional view of the apparatus of FIGS. 2–3, taken generally along section lines 4—4 of FIG. 3.

Referring now to FIG. 4, the output end 112 of shaft 56 includes a spacer 114 against which race 60 rests, a larger diameter portion 115, a threaded portion 116, and a straight-tapered portion 118, with an internally threaded bore 122.

A cup-shaped slinger 124 (FIG. 2) having a central threaded aperture 126 is threaded onto portion 116 of shaft end 112. Slinger 124 is tightened against portion 115. Slinger 124 prevents coating material, e.g., paint, from migrating upwardly along shaft 56 from atomizing device 11 and fouling the lower bearings 66 of motor 10. Device 11 is as described in connection with the embodiment of FIG. 1.

In the embodiment of FIGS. 2–5, additional services are provided through the insulating post 14 and the lower motor housing portion 32 for the rotating atomizing device 11. Specifically, and with reference to FIGS. 2, 4, solvent delivery passageways 220 are formed in the post 14 and motor housing portion 32 for delivery of a solvent to the interior of the paint cup 134 of device 11 through a solvent tube 222. A fitting 224 provides access into the passageway 220 along the side of column 14, and an additional flexible coiled solvent delivery line 226 (see also FIG. 3) extends from tap 224 to a fitting 228 on a cleaning shroud 230.

Figure 2:
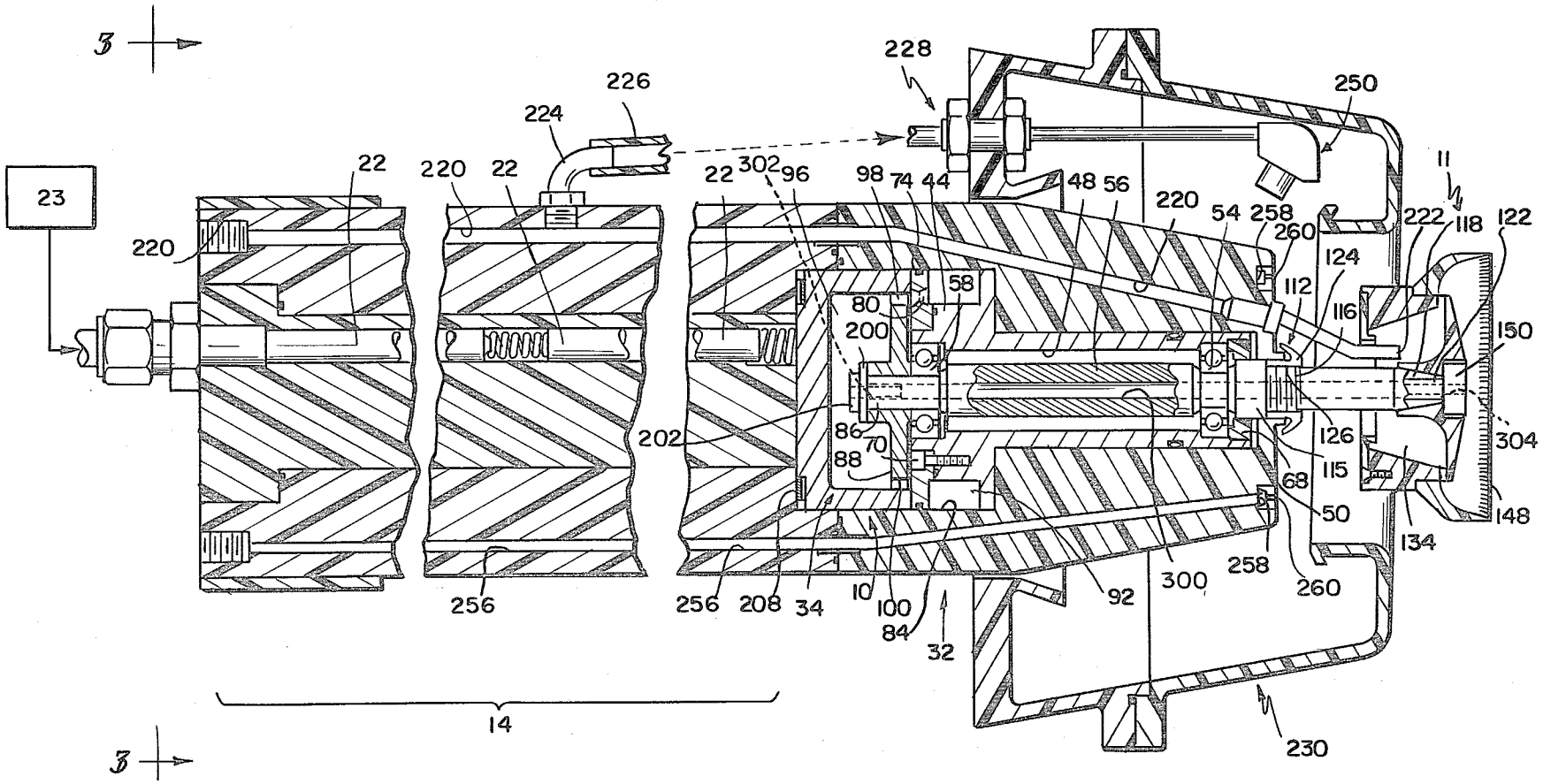
FIG. 2 is a partly fragmentary longitudinal sectional view of a fluid motor and atomizing device arrangement constructed according to the present invention, in a side-feed orientation.
Figure 3:
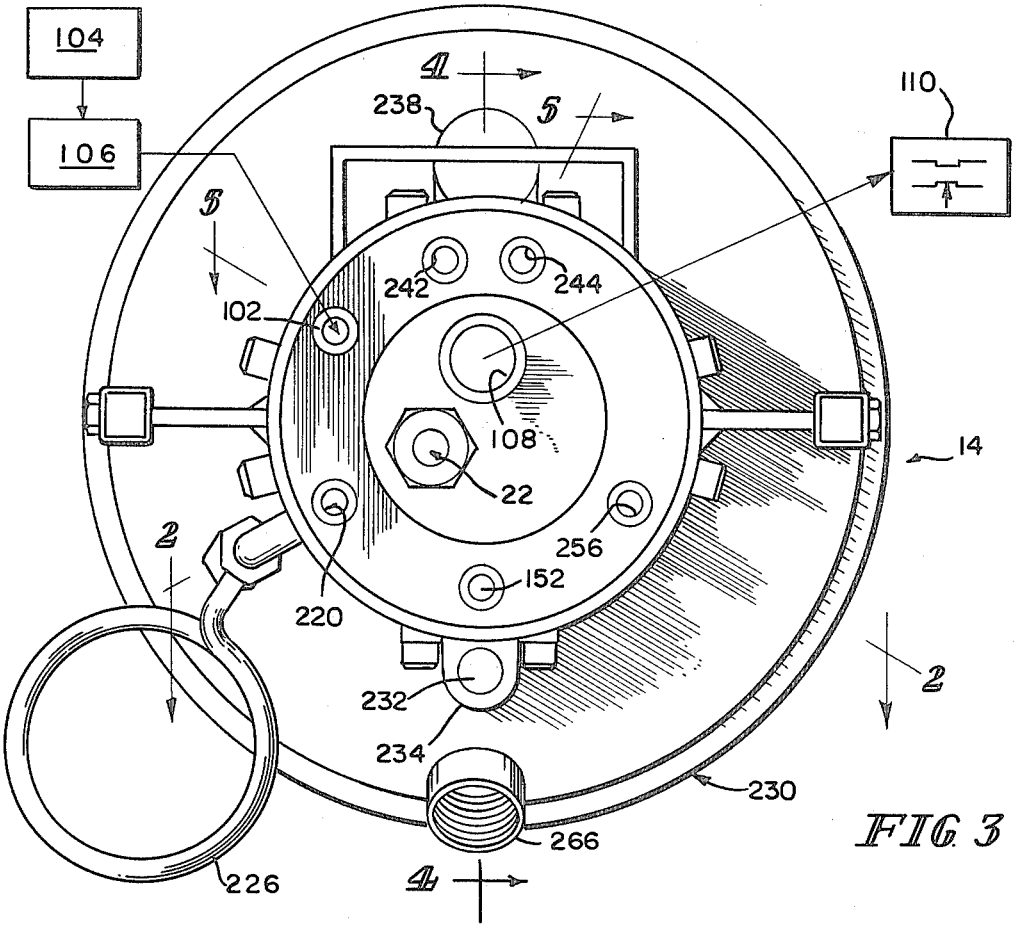
FIG. 3 is a plan view of the apparatus of FIG. 2, taken generally along section lines 3—3 of FIG. 2.

Shroud 230 is mounted from post 232 and bushing 234 for reciprocating movement relative to device 11. Compare FIGS. 2 and 4. Such reciprocating movement is achieved by a piston rod 236, a cylinder 238, and a double-acting piston 240 mounted along the side of the column 14. Shroud 230 projecting and retracting air services are provided through passageways 242, 244, respectively, which extend along the length of column 14. The shroud 230 is projected after a coating operation is completed, e.g., during a change in the color of the paint to be delivered through tube 152 while solvent is being dispensed through 220, 222, 224, 226 (FIG. 2). A flushing nozzle 250 is disposed within shroud 230 and is connected to fitting 228. When shroud 230 is in its extended position, illustrated in FIG. 4, solvent is supplied through 220, 224, 226 and fitting 228 to the nozzle 250. A stream of solvent is directed onto the rotating atomizing device 11 to rinse any paint residue from device 11.

An additional service for shaping air is provided through a passageway 256 (FIGS. 2 and 5) which extends along the column 14. Shaping air is delivered through passageway 256 to shape the envelope of atomized and electrostatically charged paint particles as they are dispensed from edge 148 of atomizing device 11. This shaping air is delivered through an annular channel 258 to a series of holes 260 at the end of motor housing portion 32.

Shroud 230 is shaped to provide a well portion 264 (FIG. 4) toward which all liquid solvent, etc., in the shroud flows. A threaded bore 226 is provided in the shroud to support a drain (not shown) in the well 264 to evacuate such solvent, etc., from the shroud.

Again, the system of FIGS. 2–5, as described thus far, produces a film build on a moving flat sheet target, best illustrated in FIG. 6. The film peaks at about 16 inches (40.64 cm) above the vertical center of the shaft 56 and at about 16 inches (40.64 cm) below the center of shaft 56. This result was achieved with an atomizing device 11 having a diameter at edge 148 of 2.875 inches (7.3 cm).

In order to overcome the partial vacuum which is believed to account for this film build profile, shaft 56 includes a central longitudinal bore 300. Retaining screw 202 includes a registering bore 302. Bolt 150 includes a registering bore 304. Because of the construction of the motor with the shaft 56 inner end terminating in low-pressure chamber 96, motor 10 exhaust air is fed directly through passageways 302, 300, 304 from low-pressure chamber 96 to disrupt the void. This essentially provides a parallel exhaust path for spent air in the low-pressure side of the chamber. A variable restrictor 110 (FIG. 3) on the exhaust 108 of motor 10, can be used in parallel with the passageways 302, 300, 304 to determine how much air is fed along these passageways to disrupt the void.

Low-pressure air fed along shaft 56 from low-pressure side 96 of motor 10 exits through bolt 150 to disrupt the low-pressure area in the center of the coating material pattern illustrated in FIG. 6. This renders the center) of shaft 56 and falls away gradually and uniformly from the center, both toward the top and bottom of the pattern.

What is claimed is:

1. In a gas turbine motor for driving a rotating atomizing device, the motor having a shaft, an atomizing device side from which the shaft projects for mounting the atomizing device, an interior divided into an inlet side and an exhaust side, a partition separating the inlet side from the exhaust side, the partition providing at least one gas-directing nozzle, a turbine wheel mounted on the shaft adjacent the partition and including means against which the gas impinges as it passes through the nozzle to spin the turbine wheel and shaft, the shaft including means providing a passageway extending longitudinally therethrough, means providing access to the passageway from a point remote from the atomizing device mounting end of the shaft, and means providing an exhaust from the passageway at the atomizing device-mounting end for exhausting motor driving gas therethrough.

2. The apparatus of claim 1 wherein the inlet side of the turbine motor is on the atomizing device side of the partition.

3. The apparatus of claim 1 wherein the shaft terminates interiorly of the turbine motor on the exhaust side of the partition.

4. The apparatus of claim 3 wherein the means providing access to the passageway from a point remote from the atomizing device mounting end of the shaft includes an opening from the passageway to the end of the shaft remote from the atomizing device mounting end.

5. The apparatus of claim 1 or 3 wherein the exhaust side of the turbine motor interior includes means providing an exhaust port for exhausting spent driving gas in parallel with the exhausting of gas through the shaft passageway.

6. The apparatus of claim 5 and further including a throttle, and means for mounting the throttle to control the flow of spent driving gas from the exhaust port.

7. In combination, a gas turbine motor, an atomizing device for high-speed rotation by the motor, and means for feeding coating material to the atomizing device for atomization thereby, the motor having a shaft which projects from the motor for mounting the atomizing device, a turbine wheel mounted on the shaft to spin it, the shaft including means providing a passageway extending longitudinally therethrough, means providing access to the passageway from a point remote from the atomizing device, and means providing an exhaust from the passageway at the atomizing device for exhausting motor driving gas therethrough.

8. The apparatus of claim 7 wherein the shaft terminates interiorly of the turbine motor on the exhaust side of the motor.

9. The apparatus of claim 8 wherein the means providing access to the passageway from a point remote from the atomizing device includes an opening from the passageway to the interior termination of the shaft.

10. The apparatus of claim 7 or 8 wherein the exhaust side of the turbine motor includes means providing an exhaust port for exhausting spent driving gas in parallel with the exhausting of gas through the shaft passageway.

11. The apparatus of claim 10 and further including a throttle, and means for mounting the throttle to control the flow of spent driving gas from the exhaust port.

* * * * *

UNITED STATES PATENT AND TRADEMARK OFFICE

CERTIFICATE OF CORRECTION

PATENT NO. : 4,381,079

DATED : April 26, 1983

INVENTOR(S) : Harold T. Allen

It is certified that error appears in the above-identified patent and that said Letters Patent is hereby corrected as shown below:

Column 2, line 48, delete "grove groove." and insert --groove 72.-- therefor.

Column 2, line 61, delete "drive" and insert --driven-- therefor.

Column 3, line 44, delete "devide" and insert --device-- therefor.

Column 4, line 4, delete "porton" and insert --portion-- therefor.

Column 5, line 62, delete "accodance" and insert --accordance-- therefor.

Column 7, line 53, delete "226" and insert --266-- therefor.

UNITED STATES PATENT AND TRADEMARK OFFICE

CERTIFICATE OF CORRECTION

PATENT NO. : 4,381,079

DATED : April 26, 1983

INVENTOR(S) : Harold T. Allen

It is certified that error appears in the above-identified patent and that said Letters Patent is hereby corrected as shown below:

Column 8, lines 14-17 should be deleted and the following should be inserted therefor --rial pattern illustrated in Fig. 6. This renders the coating material thickness greatest at the center of rotation of the atomizing device 11 (labelled center in Fig. 7) and the coating material thickness falls away gradually and uniformly from the center, both toward the top and bottom of the pattern.--.

Signed and Sealed this

*Thirteenth* Day of *December 1983*

[SEAL]

*Attest:*

GERALD J. MOSSINGHOFF

*Attesting Officer*

*Commissioner of Patents and Trademarks*